US007602341B2

(12) United States Patent
Wei-Shan et al.

(10) Patent No.: US 7,602,341 B2
(45) Date of Patent: Oct. 13, 2009

(54) MULTI-BAND ANTENNA

(75) Inventors: Chang Wei-Shan, Taipei Hsien (TW); Wang Chih-Ming, Taipei Hsien (TW); Cheng Pi-Hsi, Taipei Hsien (TW)

(73) Assignee: Wistron NeWeb Corp., Taipei Hsien (TW)

( * ) Notice: Subject to any disclaimer, the term of this patent is extended or adjusted under 35 U.S.C. 154(b) by 6 days.

(21) Appl. No.: 12/003,447

(22) Filed: Dec. 26, 2007

(65) Prior Publication Data

US 2008/0180330 A1 Jul. 31, 2008

(30) Foreign Application Priority Data

Jan. 25, 2007 (TW) ..... 96201502 U

(51) Int. Cl.
*H01Q 5/00* (2006.01)
*H01Q 1/24* (2006.01)

(52) U.S. Cl. ..... 343/700 MS; 343/702; 343/846

(58) Field of Classification Search ..... 343/700 MS, 343/702, 846
See application file for complete search history.

(56) References Cited

U.S. PATENT DOCUMENTS 7,446,717 B2 * 11/2008 Hung et al. ..... 343/702

* cited by examiner

*Primary Examiner*—Daniel D Chang
(74) *Attorney, Agent, or Firm*—Muncy, Geissler, Olds & Lowe, PLLC

(57) ABSTRACT

A multi-band antenna includes a ground, an asymmetric T-shaped radiation element, an inverted L-shaped conduction element, and a parasitic element. The asymmetric T-shaped radiation element has a first radiation part, a second radiation part, and a first conduction part. The length of the second radiation part is shorter than that of the first radiation part. The inverted L-shaped conduction element has a second conduction part and a third conduction part. The second conduction part is connected to the first conduction part, and arranged between the second radiation part and the ground. The parasitic element has a fourth conduction part and a third radiation part. The fourth conduction part is connected approximately perpendicular to the ground. The third radiation part is arranged between the first radiation part and the ground.

20 Claims, 8 Drawing Sheets

MULTI-BAND ANTENNA

RELATED APPLICATIONS

This application claims priority to Taiwan Application Serial Number 96201502, filed Jan. 25, 2007, which is herein incorporated by reference.

BACKGROUND OF THE INVENTION

1. Field of Invention

The invention relates to an antenna structure and, in particular, to a multi-band antenna structure.

2. Related Art

The connections and communications in wireless personal area network (WPAN), wireless local area network (WLAN), and wireless wide area network (WWAN) or among various wireless devices can be implemented using the antennas therein.

Generally speaking, the antenna of a wireless device can be external or internal. For example, some laptop computers have external antennas on top of the screens or on PCMCIA cards. Since these external antennas are exposed to the environment, they are more expensive and susceptible to damages. The other design is to build the antenna directly inside the laptop computer.

The built-in antenna design can avoid some problems of the external antenna. For example, the appearance of the computer is better. The antenna is less likely to be damaged by accident. However, putting the antenna inside the limited space of a small computer device has several constraints. To fit into the allowed space, some operating bandwidths are sacrificed. Therefore, the allowed error rate of such antennas is very small, resulting in a higher cost for mass production. Therefore, how to design a new internal antenna structure to increase its bandwidth is an important goal for the manufacturers.

SUMMARY OF THE INVENTION

It is an objective of the invention to provide a multi-band antenna for receiving and sending signals in a wireless device such as a laptop computer, with a sufficiently large operating bandwidth.

In accord with the above objective, the disclosed multi-band antenna has a ground, an asymmetric T-shaped radiation element, an inverted L-shaped conduction element, and a parasitic element. The asymmetric T-shaped radiation element has a first radiation part, a second radiation part, and a first conduction part. The first conduction part is approximately perpendicular to the first and second radiation parts. The first radiation part receives signals in a first radiation band. The second radiation part receives signals in a second radiation band. The length of the second radiation part is smaller than that of the first radiation part.

The inverted L-shaped conduction part has a second conduction part and a third conduction part. The second conduction part is connected to the first conduction part, and arranged between the second radiation part and the ground. The third conduction part is connected approximately perpendicular to the ground. The parasitic element has a fourth conduction part and a third radiation part. The fourth conduction part is connected approximately perpendicular to the ground. The third radiation part is disposed between the first radiation part and the ground.

According to one embodiment of the invention, the disclosed multi-band antenna has a first ground, an asymmetric T-shaped radiation element, an inverted L-shaped conduction element, and a parasitic element. The asymmetric T-shaped radiation element has a first radiation part, a second radiation part, and a first conduction part. The first conduction part is approximately perpendicular to the first and second radiation parts, and on a different plane from the first and second radiation parts. The first and second radiation parts are parallel to the first ground. The first radiation part receives signals in a first radiation band. The second radiation part receives signals in a second radiation band. The length of the second radiation part is smaller than that of the first radiation part.

The inverted L-shaped conduction part and the first conduction part are on the same plane. The inverted L-shaped conduction part has a second conduction part and a third conduction part. The second conduction part is connected to the first conduction part, and arranged between the second radiation part and the first ground. The third conduction part is connected approximately perpendicular to the first ground. The parasitic element is on the same plane as an impedance adjusting board, and has a fourth conduction part and a third radiation part. The fourth conduction part is connected approximately perpendicular to the first ground. The third radiation part is disposed between the first radiation part and the first ground.

The second conduction part of the above-mentioned multi-band antenna is disposed between the second radiation part and the ground in order to increase the operating bandwidth of the first radiation part. Besides, a parasitic element is provided to increase the operating bandwidth in the vicinity of the second band. Therefore, the multi-band antenna has the function of operating in two bands.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

An embodiment of the invention is a multi-band antenna installed on a portable electronic device with the wireless communication function, such as a laptop computer or personal digital assistant (PDA). The multi-band antenna has to be capable of receiving signals in two or more frequency bands. For simplicity, the specification refers exclusively to their central frequencies unless otherwise specified. In other words, we use a first frequency and a second frequency to refer to the two bands. Any person skilled in the art can vary different parameters in the antenna design for different applications.

FIRST EMBODIMENT

Figure 1:
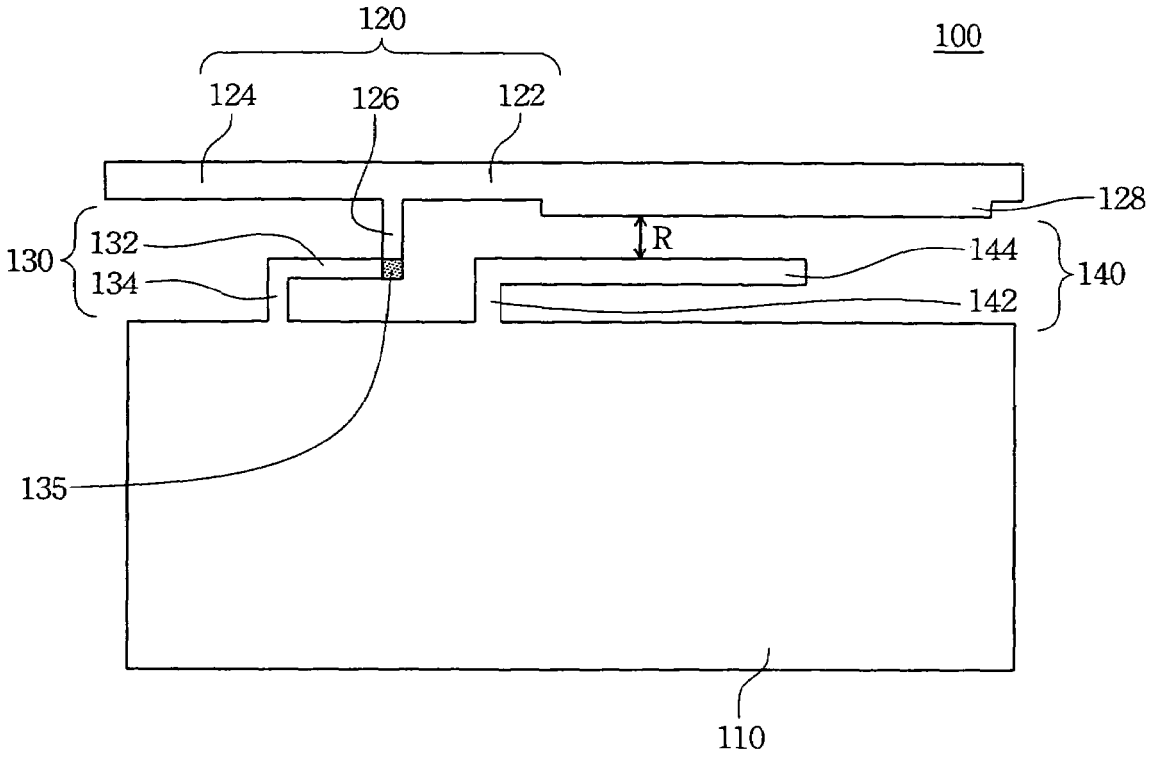
FIG. 1 is a schematic view of the multi-band antenna in the first embodiment of the invention.

As shown in FIG. 1, the multi-band antenna 100 in this embodiment has a ground 110, an asymmetric T-shaped radiation element 120, an inverted L-shaped conduction element 130, and a parasitic element 140.

The asymmetric T-shaped radiation element 120 includes a first radiation part 122, a second radiation part 124, and a first conduction part 126. The first radiation part 126 is approximately perpendicular to the first radiation part 122 and the second radiation part 124. The first radiation part 122 receives signals in the first radiation band. The second radiation part 124 receives signals in the second radiation band. Besides, the length of the second radiation part 124 is smaller than that of the first radiation part 122.

The inverted L-shaped conduction part 130 includes a second conduction part 132 and a third conduction part 134. The second conduction part 132 is connected to the first conduction part 126, and arranged between the second radiation part 124 and the ground 110. The third conduction part 134 is approximately perpendicular to the ground 110.

The parasitic element 140 includes a fourth conduction part 142 and a third radiation part 144. The fourth conduction part 142 is connected approximately perpendicular to the ground 110. The third radiation part 144 is disposed between the first radiation part 122 and the ground 110. The parasitic element 140 in this embodiment has an inverted L shape.

Besides, the first radiation part 122 has an impedance adjusting board 128, extending from the edge of the first radiation part 122 in the vicinity of the gourd 110 and separated from the third radiation part 144 by a predetermined distance R.

To increase the bandwidths of the first and second radiation frequencies, the second conduction part 132 is disposed between the second radiation part 124 and the ground 110 in this embodiment to increase the operating bandwidth of the first radiation part 122. Besides, the third radiation part 144 of the parasitic element 140 is used to generate an additional operating band. In order to employ the operating band produced by the third radiation part 144 to extend the bandwidth of the second radiation frequency, the first radiation part 122 is further disposed with an impedance adjusting board 128. The impedance adjusting board 128 is separated from the third radiation part 144 by a predetermined distance R. The radiation band of the third radiation part 144 is changed by adjusting the predetermined distance R, so that it is close to the second radiation frequency, thus enlarging the bandwidth thereof. The first conduction part 126 and the second conduction part 132 are connected via a connecting point, which is the signal feed-in point 135 of the multi-band antenna 200.

SECOND EMBODIMENT

The first embodiment is only a basic embodiment of the disclosed multi-band antenna. In practice, the multi-band antenna can be designed to have a three-dimensional structure in order to fit the space arrangement of the portable electronic device and to increase the efficiency thereof.

Figure 2:
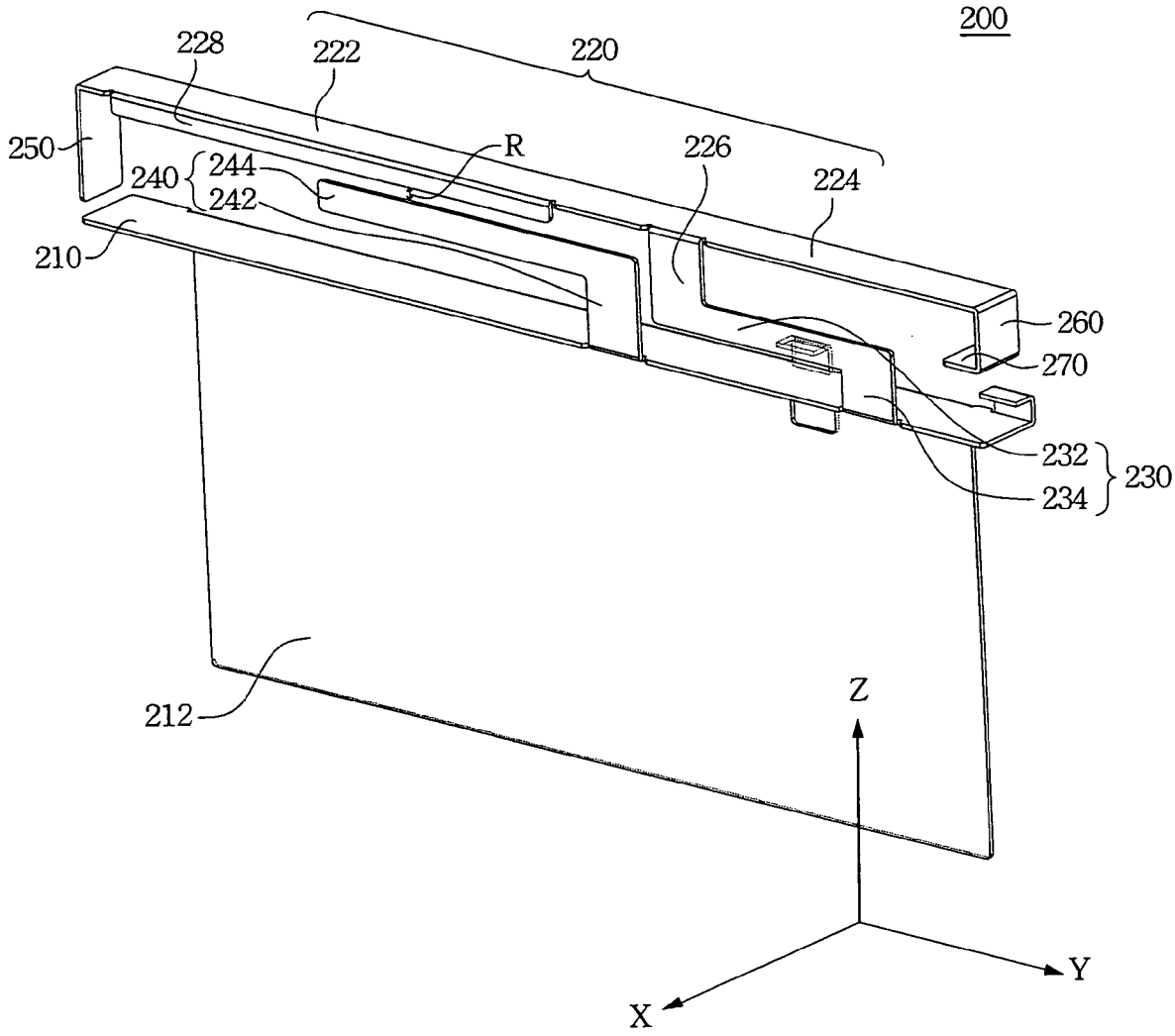
FIG. 2 is a schematic view of the multi-band antenna in the second embodiment of the invention.

As shown in FIG. 2, the multi-band antenna 200 in this embodiment has a first ground 210, an asymmetric T-shaped radiation element 220, an inverted L-shaped conduction element 230, and a parasitic element 240. The asymmetric T-shaped radiation element 220 has a first radiation part 222, a second radiation part 224, and a first conduction part 226. The first conduction part 226 is approximately perpendicular to the first radiation part 222 and the second radiation part 224, and on a different plane from the first radiation part 222 and the second radiation part 224. The first radiation part 222 and the second radiation part 224 are parallel to the first ground 210. The first radiation part 222 receives signals in the first radiation band. The second radiation part 224 receives signals in the second radiation band. The length of the second radiation part 224 is smaller than that of the first radiation part 222.

The inverted L-shaped conduction element 230 and the first conduction part 226 are located on the same plane. The inverted L-shaped conduction element 230 has a second conduction part 232 and a third conduction part 234. The second conduction part 232 is connected to the first conduction part 226, and disposed between the second radiation part 224 and the first ground 210. Moreover, the third conduction part 234 is connected approximately perpendicular to the first ground 210.

The parasitic element 240 is also on the same plane as the first conduction part 226. The parasitic element 240 has a fourth conduction part 242 and a third radiation part 244. The fourth conduction part 242 is connected approximately perpendicular to the first ground 210. The third radiation part 244 is disposed between the first radiation part 222 and the first ground 210.

In this embodiment, the multi-band antenna 200 further includes a second ground 212 connected perpendicular to the first ground 210. To adjust the radiation band of the third radiation part 244, an impedance adjusting board 228 is provided on the first radiation part 222. The impedance adjusting board 228 is located on the same plane as the first conduction part 226, extending from the edge of the first radiation part 222 vertically toward the first ground 210 and separated from the third radiation part 224 by a predetermined distance R.

Besides, the shape of the asymmetric T-shaped radiation element 220 can be modified in order to fit the allowed space, achieving the highest efficiency for the multi-band antenna 200. In this embodiment, the asymmetric T-shaped radiation element 200 further includes a first bending portion 250 and a second bending portion 260. The first bending portion 250 is connected perpendicular to the end of the first radiation part 222. The second bending portion 260 is connected perpendicular to the end of the second radiation part 224. Moreover, the end of the second bending portion 260 has a third protruding part 270 approximately parallel to the second radiation part 224.

To further illustrate the functions of the multi-band antenna in this embodiment, it is used on a wireless wide area network (WWAN), working in the bands 824~960 Mhz and 1710~2170 Mhz. In this case, the first radiation part 222 has a length of about 45.8 mm. The second radiation part 224 has a length of about 21.8 mm. The first bending portion 250 has a length of about 7.9 mm. The second bending portion 260 has a length of about 4.4 mm. The third protruding part 270 has a length of about 3.1 mm. The impedance adjusting board 228 has a length of about 35.2 mm. The third radiation part 244 has a length of about 21.53 mm. The predetermined distance R between the impedance adjusting board 228 and the third radiation part 244 is about 1 mm. The following experimental data are obtained using the multi-band antenna with the above-mentioned component sizes.

Figure 3:
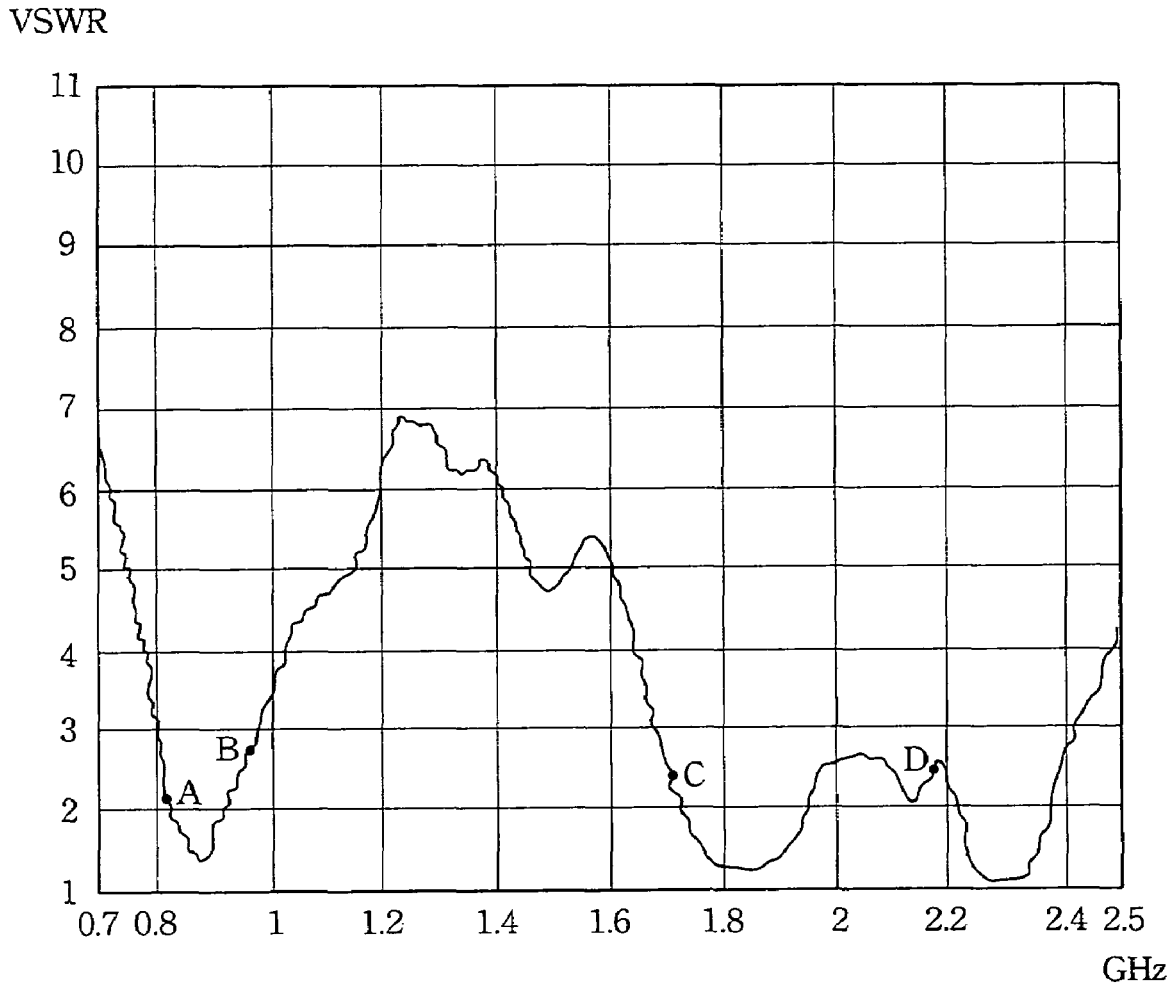
FIG. 3 shows the VSWR of the second embodiment with the impedance adjusting board removed.
Figure 4:
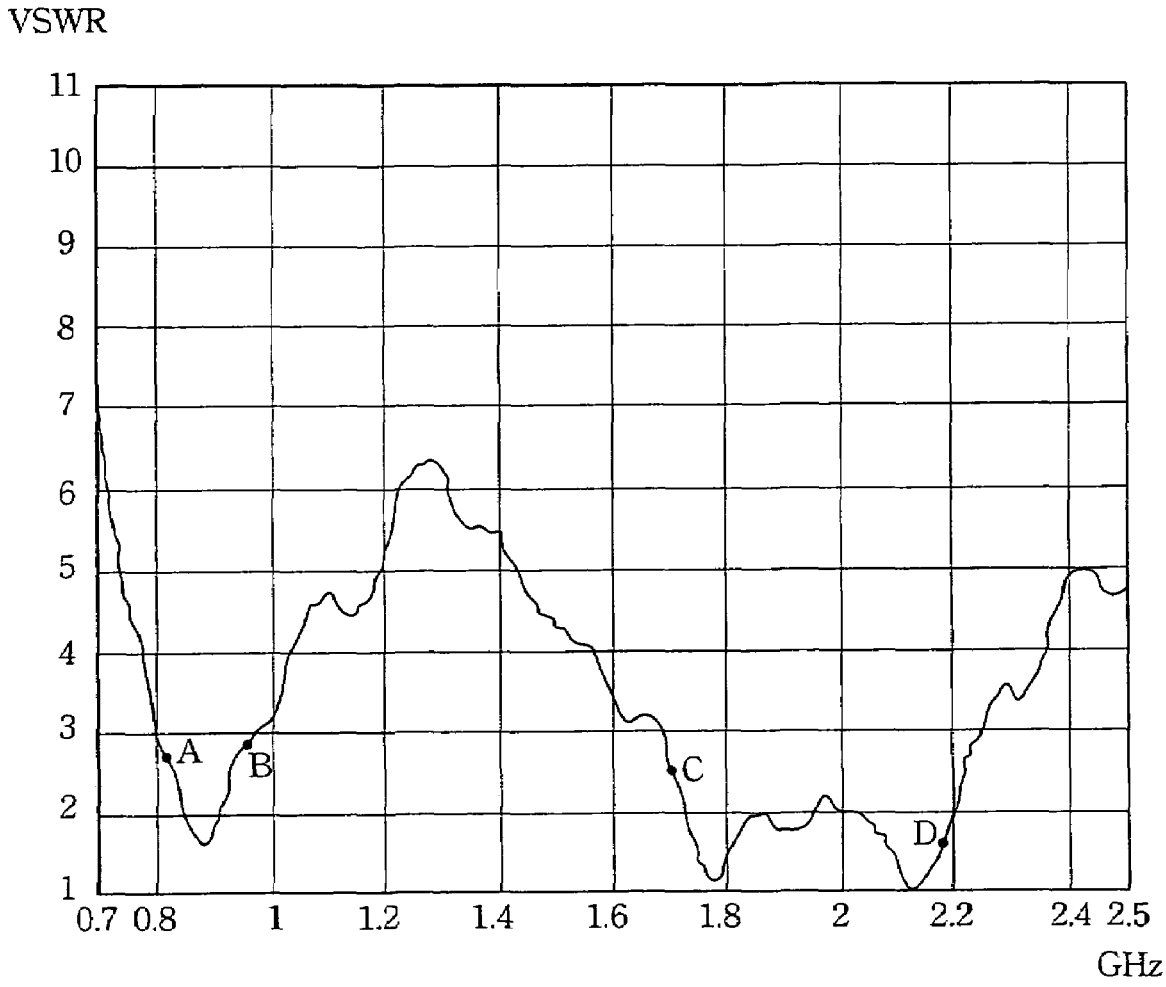
FIG. 4 shows the VSWR of the second embodiment.

Please refer simultaneously to FIGS. 3 and 4. FIG. 3 shows the voltage standing wave ratio (VSWR) of the multi-band antenna without the impedance adjusting board in the second embodiment. FIG. 4 shows the VSWR of the second embodiment. The horizontal axis and the vertical axis in both figures represent respectively the frequency and the VSWR. The frequency of point A is 824 MHz, point B 960 MHz, point C 1710 MHz, and point D 2170 MHz. Since the length of the second radiation part is smaller than that of the first radiation part, the second radiation band of the second radiation part corresponds to the high frequency band 1710~2170 Mhz of the WWAN. The first radiation band of the first radiation part, on the other hand, corresponds to the low frequency band 824~960 Mhz of the WWAN.

In FIG. 3, the VSWR between point C and point D is mostly above 2. Particularly, the VSWR is all above 2 in the range of 1950 MHz~2200 MHz. In FIG. 4, the VSWR in the range of 1710~2170 Mhz is almost all below 2 after the use of the impedance adjusting board. Therefore, the high frequency band of the multi-band antenna is manipulated by both the high-frequency radiation part and the parasitic element. The impedance adjusting board adjusts the radiation band of the parasitic element, so that the two bands are next to each other for increasing the bandwidth of the high frequency band. In FIG. 4, the bandwidth of the low frequency band is about 18% in the case where the VSWR is smaller than 3. Therefore, the disclosed multi-band antenna provides sufficient operating bandwidths in both high and low frequencies, covering the entire WWAN bands.

Figure 5:
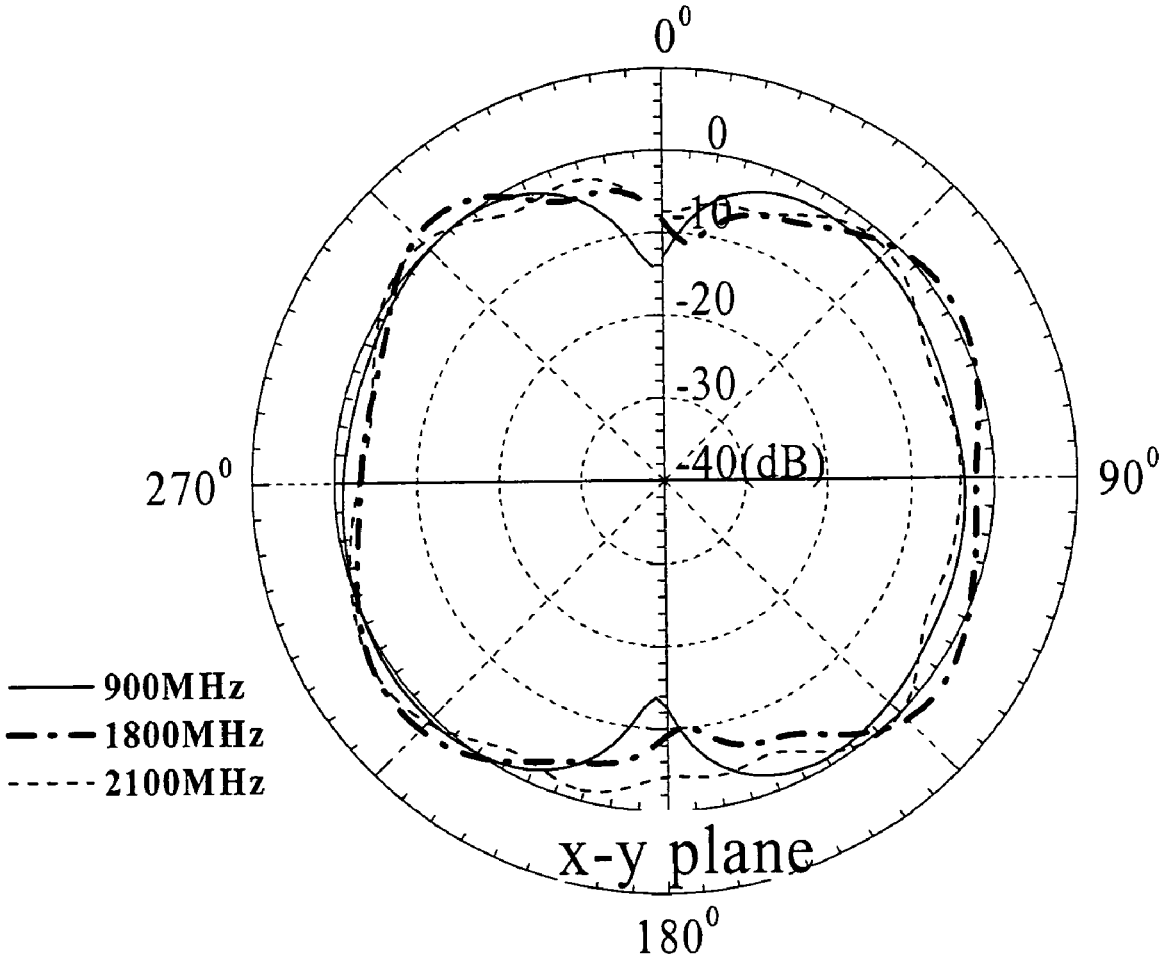
FIG. 5 shows the radiation field in a horizontal cross section of the second embodiment.

Please refer to FIG. 5 for the radiation field diagram in the horizontal cross section for the second embodiment. It shows that the multi-band antenna produces a uniform distribution of electromagnetic energy in the working bands of the WWAN on the horizontal plane. This satisfies the operating requirement of WWAN systems.

THIRD EMBODIMENT

In the above embodiment, the impedance adjusting board is rectangular. The shape of each part of the radiation parts is either rectangular or square. In other embodiments, the shapes can be modified in order to satisfy the spatial constraint and optimize the efficiency in each radiation band.

Figure 6:
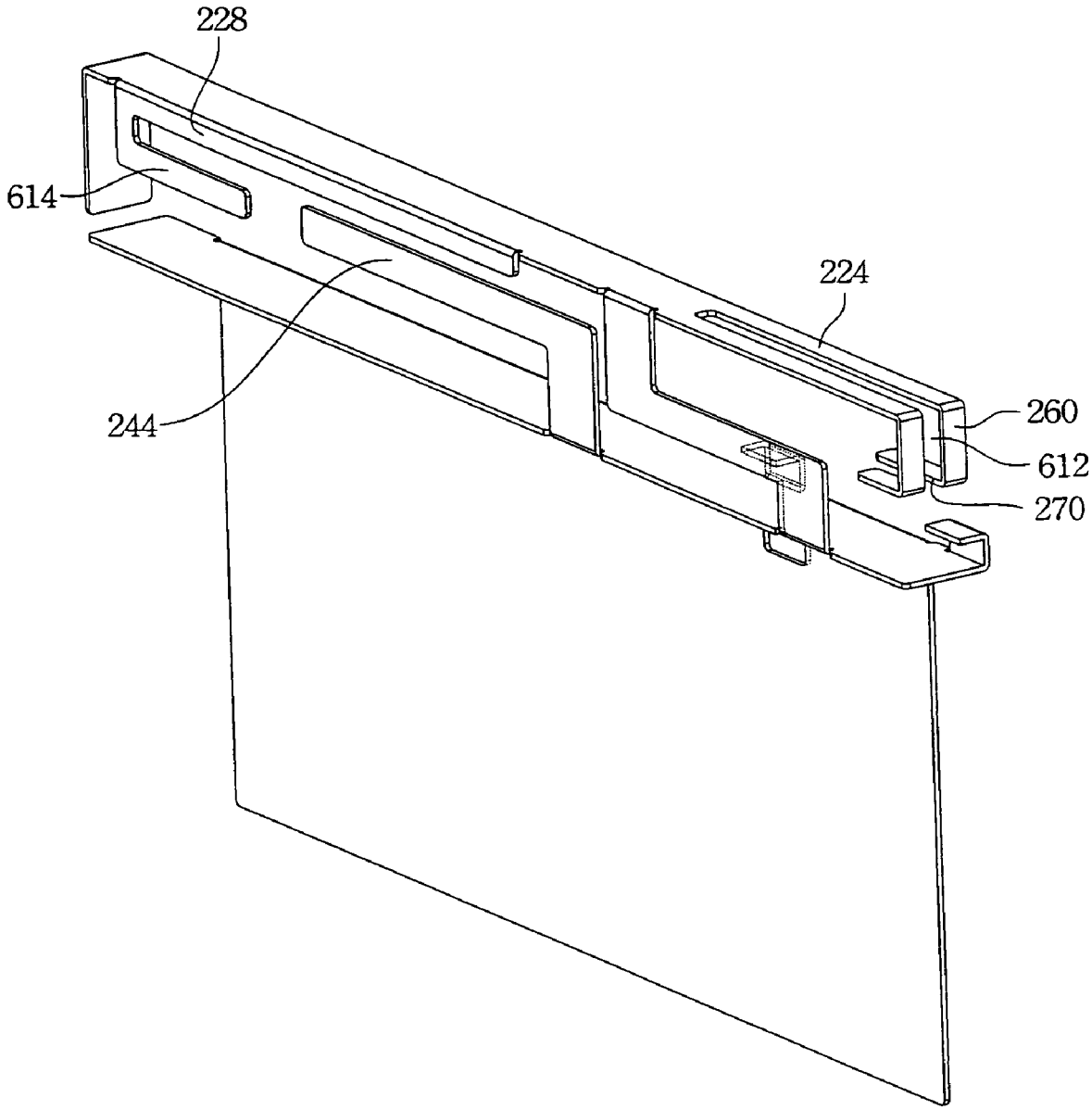
FIG. 6 is a schematic view of the multi-band antenna in the third embodiment of the invention.

As shown in FIG. 6, the second radiation part 224 in this embodiment has a groove 612, extending from the second radiation part 224 to the third protruding part 270 via the second bending portion 260, separating part of the second radiation part 224, the second bending portion 260 and the third protruding part 270 into two parts. The impedance adjusting board 228 further includes an L-shaped extension part 614 on the same plane as the impedance adjusting board 228. One end of the L-shaped extension part 614 is connected to a terminal of the impedance adjusting board 228, and its other end points to the third radiation part 244.

Figure 7A:
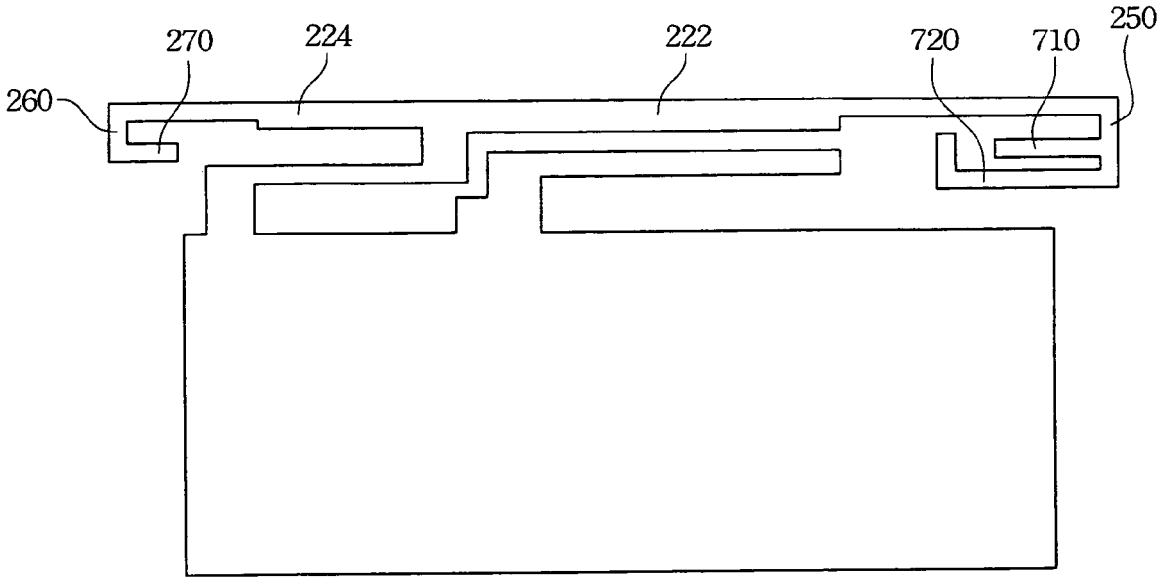
FIGS. 7A to 7C are projective views of the multi-band antennas in other embodiments of the invention.

Of course, the asymmetric T-shaped radiation element can have other variations. Please refer simultaneously to FIGS. 7A, 7B, and 7C. These drawings show the projections of the multi-band antenna in other embodiments. As shown in FIG. 7A, the first bending portion 250 on the first radiation part 222 also includes a second protruding part 710 and an L-shaped protruding part 720. The L-shaped protruding part 720 is disposed at the end of the first being portion 250. The second protruding part 710 is disposed between the L-shaped protruding part 720 and the first radiation part 222.

Figure 7B:
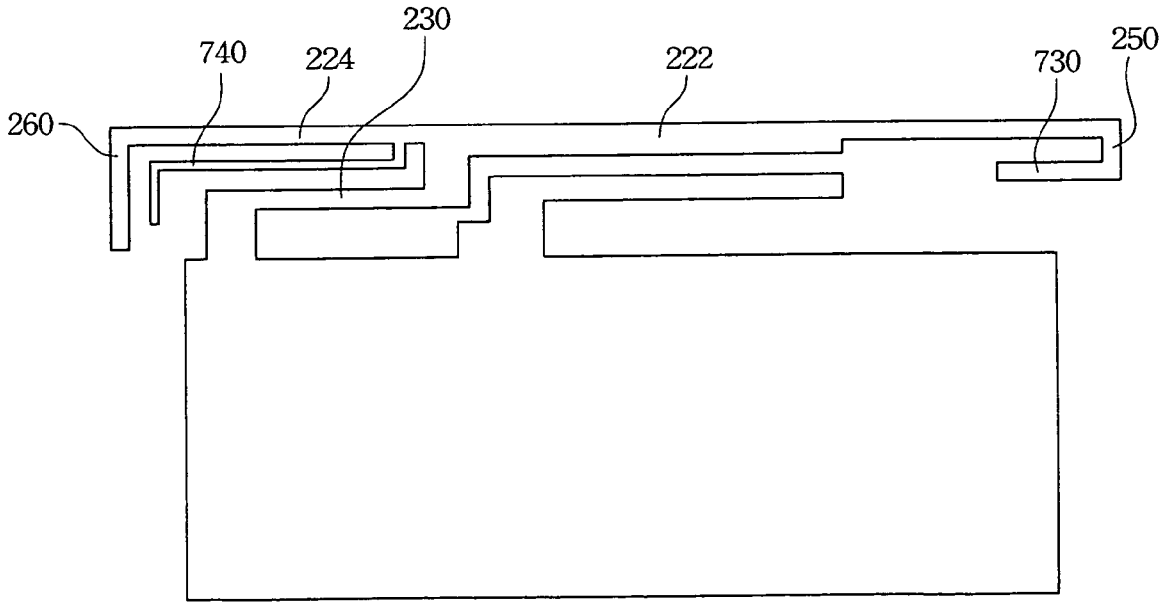

The first radiation part 222 can have other variations as well. As shown in FIG. 7B, the end of the first bending portion 250 is connected to a first protruding part 730. The first protruding part is approximately parallel to the first radiation part 222.

Figure 7C:
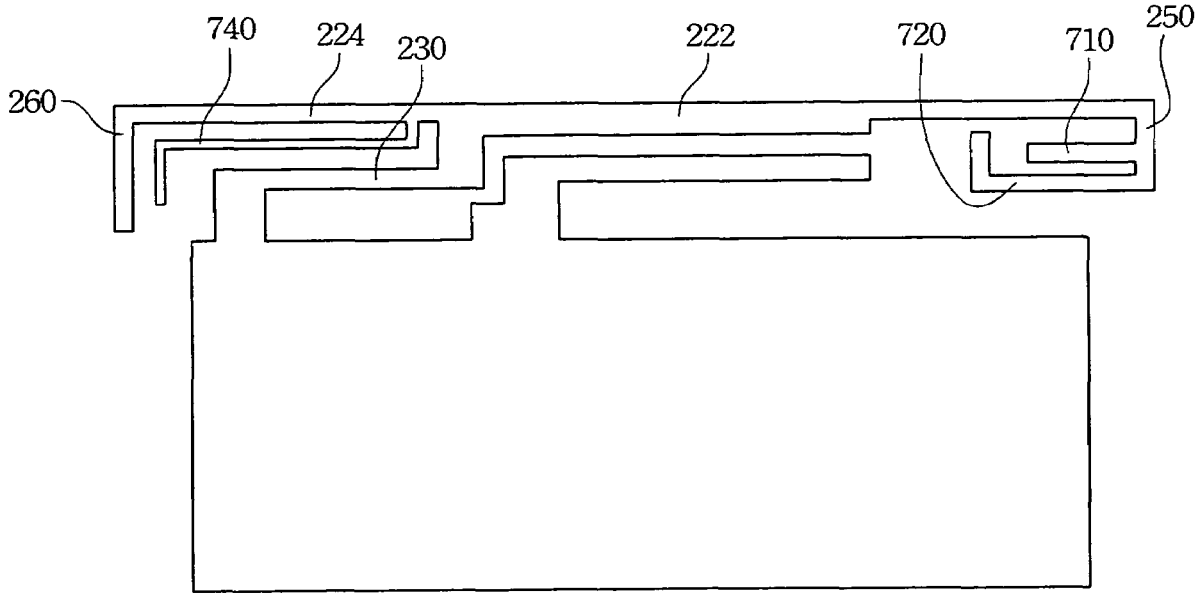

Besides, as shown in FIGS. 7B and 7C, the second radiation part 224 can have a fourth protruding part 740 between the second radiation part 224 and the inverted L-shaped conduction element 230. The shape of the fourth protruding part 740 corresponds to the second radiation part 224 and the second bending portion 260.

According to the above-mentioned embodiments of the disclosed multi-band antenna, the second conduction element is disposed between the second radiation element and the ground for increasing the operating bandwidth of the first radiation element. Moreover, a parasitic element produces an additional operating band, thereby increasing the operating bandwidth in the vicinity of the second band. Such a structure enables the multi-band antenna to achieve dual-band operating function. A larger error rate can be tolerated in mass production of the antennas, thereby reducing the production cost.

While the invention has been described by way of example and in terms of the preferred embodiment, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A multi-band antenna, comprising:

a ground;

an asymmetric T-shaped radiation element, which has a first radiation part for receiving signal in a first radiation band, a second radiation part for receiving signals in a second radiation band, and a first conduction part approximately perpendicular to the first radiation part and the second radiation part, the length of the second radiation part being smaller than that of the first radiation part;

an inverted L-shaped conduction element, which has a second conduction part connected to the first conduction part and arranged between the second radiation part and the ground, and a third conduction part connected approximately perpendicular to the ground; and a parasitic element to generate an additional operating band close to the second radiation band so as to enlarge a bandwidth of the second radiation band, wherein the parasitic element has a fourth conduction part connected approximately perpendicular to the ground, and a third radiation part disposed between the first radiation part and the ground.

2. The multi-band antenna of claim 1, wherein the first radiation part has an impedance adjusting board extending from the first radiation part in the vicinity of the ground and separated from the third radiation part by a predetermined distance.

3. The multi-band antenna of claim 2, wherein the asymmetric T-shaped radiation element includes a first bending portion connected perpendicular to the end of the first radiation part.

4. The multi-band antenna of claim 3, wherein the asymmetric T-shaped radiation element includes a first protruding part connected to the end of the first bending portion and approximately parallel to the first radiation part.

5. The multi-band antenna of claim 3, wherein the first bending portion includes a second protruding part and an L-shaped protruding part, the L-shaped protruding part being disposed at the end of the first bending portion and the second protruding part being disposed between the L-shaped protruding part and the first radiation part.

6. The multi-band antenna of claim 2, wherein the asymmetric T-shaped radiation element includes a second bending portion connected perpendicular to the end of the second radiation part.

7. The multi-band antenna of claim 6, wherein the asymmetric T-shaped radiation element includes a third protruding part connected to the end of the second bending portion and approximately parallel to the second radiation part.

8. The multi-band antenna of claim 6, wherein the asymmetric T-shaped radiation element includes a fourth protruding part disposed between the second radiation part and the inverted L-shaped conduction element and having a shape corresponding to the second radiation part and the second bending portion.

9. The multi-band antenna of claim 1, wherein the first conduction part and the second conduction part are connected via a connecting point, which is the signal feed-in point of the multi-band antenna.

10. A multi-band antenna, comprising:

a first ground;

an asymmetric T-shaped radiation element, which has a first radiation part for receiving signal in a first radiation band, a second radiation part for receiving signals in a second radiation band, and a first conduction part approximately perpendicular to the first radiation part and the second radiation part and on a different plane from them, the first radiation part and the second radiation part being parallel to the first ground, and the length of the second radiation part being smaller than that of the first radiation part;

an inverted L-shaped conduction element on the same plane as the first conduction part, which has a second conduction part connected to the first conduction part and arranged between the second radiation part and the first ground, and a third conduction part connected approximately perpendicular to the first ground; and a parasitic element on the same plane as the first conduction part, which has a fourth conduction part connected approximately perpendicular to the ground, and a third radiation part disposed between the first radiation part and the ground. wherein the parasitic element generates an additional operating band close to the second radiation band so as to enlarge a bandwidth of the second radiation band.

11. The multi-band antenna of claim 10 further comprising a second ground connected perpendicular to the first ground.

12. The multi-band antenna of claim 10, wherein the first radiation part has an impedance adjusting board on the same plane as the first conduction part and the impedance adjusting board extends from the edge of the first radiation part vertically toward the first ground, separated from the third radiation part by a predetermined distance.

13. The multi-band antenna of claim 12, wherein the asymmetric T- shaped radiation element includes a first bending portion connected perpendicular to the end of the first radiation part.

14. The multi-band antenna of claim 13, wherein the asymmetric T-shaped radiation element includes a first protruding part connected to the end of the first bending portion and approximately parallel to the first radiation part.

15. The multi-band antenna of claim 13, wherein the impedance adjusting board includes an L-shaped extension part on the same plane as the impedance adjusting board, and one end of the L-shaped extension part is connected to the terminal end of the impedance adjusting board and its other end points to the third radiation part.

16. The multi-band antenna of claim 13, wherein the first bending portion includes an L-shaped protruding part disposed at the end of the first bending portion and a second protruding part disposed between the L-shaped protruding part and the first radiation part.

17. The multi-band antenna of claim 12, wherein the asymmetric T- shaped radiation element includes a second bending portion connected perpendicular to the end of the second radiation part.

18. The multi-band antenna of claim 17, wherein the asymmetric T- shaped radiation element includes a third protruding part connected to the end of the second bending portion and approximately parallel to the second radiation part.

19. The multi-band antenna of claim 17, wherein the asymmetric T- shaped radiation part includes a fourth protruding part disposed between the second radiation part and the inverted L-shaped conduction element and having a shape corresponding to the second radiation part and the second bending portion.

20. The multi-band antenna of claim 10, wherein the first conduction part and the second conduction part are connected via a connecting point, which is the signal feed-in point of the multi-band antenna.

* * * * *